US010994969B2

(12) United States Patent
Lien et al.

(10) Patent No.: US 10,994,969 B2
(45) Date of Patent: May 4, 2021

(54) REMOTE OPERATED LATCH ASSEMBLY AND LIFTING HOOK WITH SUCH AN ASSEMBLY

(71) Applicant: Enerpac Tool Group Corp., Menomonee Falls, WI (US)

(72) Inventors: Eldar Lien, Bergen (NO); Wojciech Piotr Wypych, Bergen (NO)

(73) Assignee: Enerpac Tool Group Corp., Menomonee Falls, WI (US)

( * ) Notice: Subject to any disclaimer, the term of this patent is extended or adjusted under 35 U.S.C. 154(b) by 69 days.

(21) Appl. No.: 16/330,788

(22) PCT Filed: Sep. 8, 2017

(86) PCT No.: PCT/US2017/050658
§ 371 (c)(1),
(2) Date: Mar. 6, 2019

(87) PCT Pub. No.: WO2018/049144
PCT Pub. Date: Mar. 15, 2018

(65) Prior Publication Data

US 2019/0193996 A1 Jun. 27, 2019

Related U.S. Application Data

(60) Provisional application No. 62/384,821, filed on Sep. 8, 2016.

(51) Int. Cl.
*B66C 1/36* (2006.01)

(52) U.S. Cl.
CPC ..... *B66C 1/36* (2013.01)

(58) Field of Classification Search
CPC ..... B66C 1/36; B66C 1/40; F16B 45/025
USPC ..... 294/82.19, 82.2, 82.21
See application file for complete search history.

(56) References Cited

U.S. PATENT DOCUMENTS 653,021 A * 7/1900 Hamilton
3,167,346 A * 1/1965 Miller ..... B66C 1/36 294/82.34
3,575,458 A * 4/1971 Crook, Jr. ..... B66C 1/36 294/82.2

(Continued)

FOREIGN PATENT DOCUMENTS

JP 10310360 11/1998
JP 2007153583 6/2007

OTHER PUBLICATIONS

International Search Report and Written Opinion for Application No. PCT/US20171/050658 dated Feb. 2, 2018 (17 pages).

(Continued)

*Primary Examiner* — Dean J Kramer
(74) *Attorney, Agent, or Firm* — Michael Best & Friedrich LLP

(57) ABSTRACT

A lifting hook (14) provided with a remotely operated safety latch (12), wherein remote operation is used to both open and close the latch. The latch can be magnetically held (36) in the open position to connect and disconnect the load from the hook. Furthermore, an indicator (42) can be provided to indicate when the latch is latched and unlatched. The latch can be operated with lines with a first line (62) controlling one direction of movement of the latch and a second line (64) controlling a second direction of movement of the latch.

17 Claims, 2 Drawing Sheets

(56) References Cited

U.S. PATENT DOCUMENTS

| | | | | |
|---|---|---|---|---|
| 3,827,746 | A * | 8/1974 | Byers | B66C 1/36 294/82.2 |
| 4,195,872 | A | 4/1980 | Kling et al. | |
| 5,292,165 | A * | 3/1994 | Wiklund | B66C 1/36 294/82.2 |
| 5,538,303 | A * | 7/1996 | Dunham | B63B 21/54 24/599.1 |
| 5,609,378 | A * | 3/1997 | Bowers | B66C 1/36 294/82.19 |
| 5,727,834 | A * | 3/1998 | Weselowski | B66C 1/36 294/82.19 |
| 6,089,634 | A * | 7/2000 | Verhey | B66C 1/66 294/82.35 |
| 9,630,810 | B1 * | 4/2017 | Kinser, Jr. | B66C 1/36 |
| 9,776,835 | B2 * | 10/2017 | Choudhari | F16B 45/02 |
| 2005/0242602 | A1 * | 11/2005 | Protesto | B66C 1/36 294/82.21 |
| 2006/0175851 | A1 * | 8/2006 | Snyder | B66C 1/34 294/82.33 |

OTHER PUBLICATIONS

International Preliminary Report on Patentability for related Application No. PCT/US2017/050658 dated Mar. 21, 2019 (9 Pages).

* cited by examiner

REMOTE OPERATED LATCH ASSEMBLY AND LIFTING HOOK WITH SUCH AN ASSEMBLY

FIELD

The present invention generally relates to remote operated latch for closing and opening an entrance in a lifting hook, plate shackle or other types of similar devices.

SUMMARY

Lifting hooks typically include a pivotable safety latch which closes the hook opening to prevent the rigging or load, which is supported by the hook, from accidentally coming off the hook.

Connecting the lifting rigging to tall items high up in the air can be a costly and time consuming activity. Very often scaffolding has to be made for personnel to make sure the sling is installed and locked properly in the hook, or very long sling has to be made to reach down to deck level.

As such, a need may exist for a lower cost, more efficient solution to ensuring proper interconnection between a load and a lifting hook.

The present invention relates to a method and apparatus for locking and unlocking a lifting hook latch remotely when the hook is high up in the air. In some embodiments, an indicator is provided to verify whether the latch is open or closed.

One independent aspect of the present invention includes an apparatus for remotely locking and unlocking a latch of a lifting hook. The apparatus may generally include a first line coupled to the latch and extending to an operator located remotely from the lifting hook, manipulation of the first line moving the latch toward a locked condition with respect to the hook; and a second line coupled to the latch and extending to the operator located remotely from the lifting hook, manipulation of the second line moving the latch toward an unlocked condition with respect to the hook.

The apparatus may further include a visual indicator providing an indication when the latch is in the locked condition. In some embodiments, the apparatus may further include line guides coupled to the hook. Each line guides may control the position of an associated line along the hook to generate force in a direction on the latch.

In some embodiments, the first line has a first end, a second end, and middle, the middle of the first line being coupled to the latch and the first and second ends being manipulated by the operator. The second line has a first end, a second end, and middle, the middle of the second line being coupled to the latch and the first and second ends being manipulated by the operator.

In some embodiments, the first line has a first diameter on the first end and a second diameter on the second end, with the first diameter being larger than the second diameter. Some embodiments may further include a plurality of eyelets coupled to the first diameter end of the first line, the eyelets guiding the second end of the first line and the first and second ends of the second line. Some embodiments may also include a harness to be worn by the operator for managing the ends of the first and second lines, the harness having a line gathering portion with a quick release device to allow the line to be released from the harness.

Another independent aspect of the present invention includes a lifting hook providing an indication when the latch is in the locked position. The lifting hook may generally include a main body having a proximal end and a distal end defining a curved opening; a remotely operated latch pivotally coupled to the main body and selectively extending from the proximal end of the main body to the distal end of the main body when the latch is in a locked position; and an indicator providing an indication when the latch is in the locked position.

In some embodiments, the indicator may provide a second indication when the latch is in an unlocked position. In some embodiments, the indicator may include a visual indicator providing visible indicia, such as a light.

Yet another independent aspect of the present invention includes a lifting hook with a latch that can be held in an open position with a magnet, the lifting hook having a latch for selectively locking and unlocking the lifting hook, the latch having a proximal end and a distal end, the proximal end being pivotally connected to the lifting hook; an actuator coupled to the latch and adapted to pivot the latch about the proximal end between a closed position and an open position; and a magnet positioned to magnetically hold the latch in an open position against a portion of the hook.

In some embodiments, the latch and hook may have a locked condition and an unlocked condition, and the lifting hook may further include an indicator coupled to the hook to indicate the condition of the latch and hook. The indicator may include a light that illuminates when the latch and hook are in the locked condition. The lifting hook may include a switch to illuminate the indicator, connection of the distal end of the latch with the hook operating the switch.

In some embodiments, the latch may further include a biased pin that engages an opening in the latch to operate the switch. The biased pin may be biased in a direction to extend from the distal end of the latch. The hook may further include a lever coupled to the latch and actuatable to move the biased pin in a direction against the biasing force to retract the pin. The actuator of some embodiments may actuate the lever. In some embodiments, the actuator may include a line manipulated remotely by an operator on the ground. In other embodiments, the line includes a first line, and the actuator may further include a second line manipulated remotely by an operator on the ground.

Other independent features and independent aspects of the invention may become apparent by consideration of the following detailed description an accompanying drawings.

DETAILED DESCRIPTION

Figure 1:
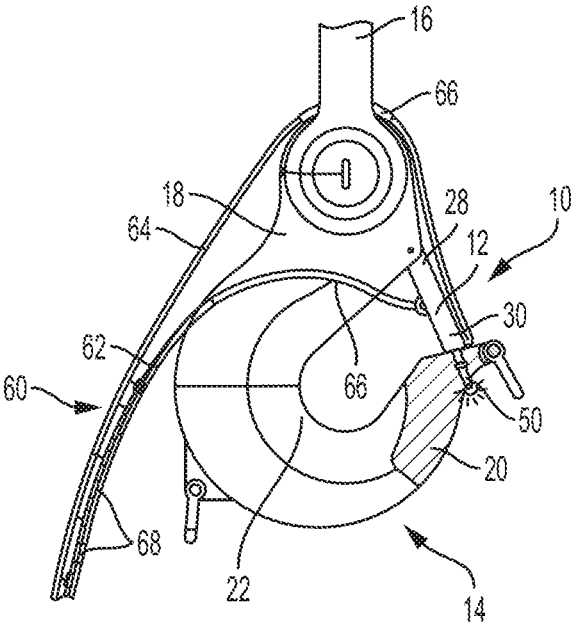
FIG. 1 is a side view of a hook assembly embodying independent aspects of the present invention, wherein the latch of the hook is in a closed, locked condition.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limited.

The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

A device 10 for remotely operating a safety latch 12 of a lifting hook 14 is shown in FIGS. 1-9. The safety latch 12 is pivotally attached to the hook 14 such that the safety latch 12 is movable between an open position (FIG. 3) and a closed position (FIG. 1). In the closed position, the safety latch 12 extends across the opening in hook 14 thereby preventing loads being carried by the hook 14 from becoming dislodged from the hook 14. In the open position, the safety latch 12 permits the removal of loads from the hook 14.

As illustrated, the hook 14 can be coupled to a shackle 16 or other connecting device for use with a crane or other lifting device. The shackle 16 is coupled to a proximal end 18 of the hook 14. The hook 14 also has a distal end 20 with an inner surface of the hook 14 extending from the proximal end 18 to the distal end 20. The latch 12 extends from the proximal end 18 of the hook 14 to the distal end 20 of the hook 14 when in the locked position.

As best shown in FIGS. 3-6, the latch 12 has a proximal end 28 and a distal end 30. The proximal end 28 is pivotally coupled to the proximal end 18 of the hook 14. The distal end 30 of the latch 12 is selectively coupled with the distal end 20 of the hook 14 to lock (when coupled) and unlock (when decoupled) the latch 12.

Figure 5:
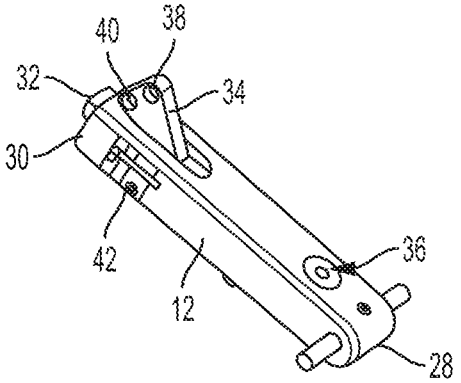
FIG. 5 is a perspective view of the latch assembly shown in FIG. 4.
Figure 6:
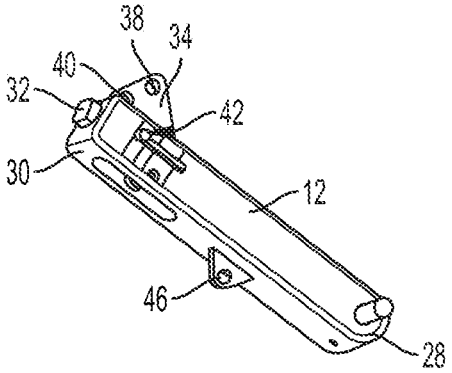
FIG. 6 is a second perspective view of the latch assembly shown in FIG. 5.

The latch 12 includes a locking pin 32 that is coupled to the distal end 30 of the latch 12. The locking pin 32 is biased toward an extended position as shown in FIGS. 5 and 6. In some embodiments, a spring is used to bias the pin 32.

A lever 34 is coupled to the distal end 30 of the latch 12 and operable to selectively move the locking pin 32 to a retracted position (not shown). As shown in the illustrated embodiment of FIG. 4, the lever 34 can include a cammed surface 44 to push against a portion of the locking pin 32 to move it against the biasing force to a retracted position. In the retracted position, the latch 12 can be pivoted to the unlocked position described above.

Although a camming mechanism is used in the illustrated embodiment, other mechanisms can be used in other embodiments to the move the locking pin. For example, an actuator can be coupled to a portion of the locking pin 32 to push or pull the pin 32.

As shown in FIGS. 5 and 6, the latch 12 can include a visual indicator 42 to indicate the position of the locking pin 32 (i.e., locked position or unlocked position). As illustrated, a portion of the pin 32 can include a visually recognizable portion that is compared to a visually indicator on the latch 12. In the illustrated embodiment, a protrusion coupled to the pin 32 extends through a slot on the latch 12. The latch 12 further includes color coded sections of green and red. When the protrusion is in the green section, the pin 32 is in the locked or biased position. When the protrusion is in the red section, the pin 32 is a retracted or unlocked position.

This indicator 42 alone may not be sufficient for knowing whether the latch 12 is locked to the hook 14. As such, some embodiments can include an indicator 50 in addition to or as an alternate to the latch indicator 42. For example, as shown on FIGS. 1-3, the hook 14 can be provided with an indictor 50 that indicates whether the locking pin 32 (and latch 12) is lockingly engaged with the hook 14. In some embodiments, a light is illuminated when the latch 12 is placed in the locked position (FIG. 1). In such an embodiment, the locking pin 32 can engage a contact switch 52 on the hook 14 to illuminate the indicator 50. In some embodiments, a first color (red) can be illuminated when the latch is not locked and a second color (green) can be illuminated when the latch is locked.

Figure 3:
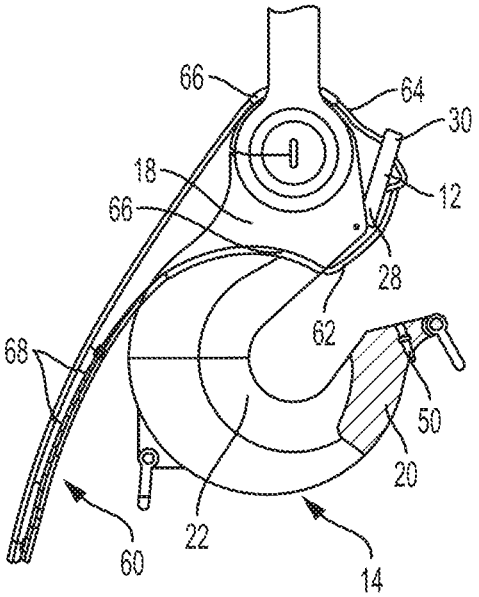
FIG. 3 is a side view of the hook of FIG. 1, wherein the latch of the hook is in the fully open, unlocked condition.

Some embodiments of the latch 12 include a magnet 36 to hold the latch 12 in the open position shown in FIG. 3. The magnet 36 is coupled to the latch 12 and configured to hold the latch 12 against the proximal end 18 of the hook 14 when the latch is pivoted to the fully open position. In the illustrated embodiment, the magnet 36 is positioned near the proximal end 28 of the latch 12. However, in other embodiments, the magnet 36 can be positioned in other locations. Alternatively, the magnet 36 can also be coupled to the hook 14 instead of the latch 12.

The latch 12 can be remotely actuated many different ways, as is known in the art. For example, electronics can be used to actuate the latch of some embodiments. However, in subsea applications, more mechanical operations are preferred due to the hook 14 being submerged in some applications. As such, in preferred embodiments, ropes or cables 60 ("lines" used herein for either ropes or cables) are used to actuate the latch 12 toward each of the locked and unlocked positions. For example, as shown in FIGS. 1-4, a first line 62 is used to move the latch 12 in the closing, locking, or latching direction. A second line 64 is used to move the latch 12 in the opening, unlocking, or unlatching direction.

Figure 2:
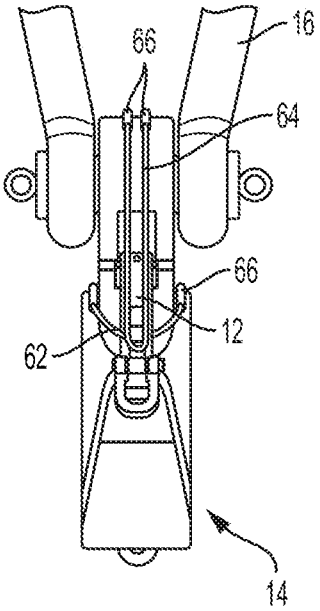
FIG. 2 is a front view of the hook shown in FIG. 1.

In a preferred embodiment, the lines 62 and 64 are specifically routed around certain portions of the hook 14 to generate forces at specific locations on the latch 12 to create specific torques or moments about the latch 12 pivot. As shown in FIGS. 1 and 2, guides 66 are provided to route the lines 62 and 64 specifically as desired. In some embodiments, the guides 66 are open channels. However, in preferred embodiments, the guides 66 are conduits or tubes in which the lines 62 and 64 must be threaded through.

In order to be able to disconnect the lines 60 easily when in use, each line 62 and 64 is used in a double configuration as shown. In other words, both ends of each line 62 and 64 is adjacent the operator with a center section of the lines 62 and 64 fed through the guides 66 and coupled to the latch 12.

When operating the latch 12, the operator needs to pull both tails of a line to move the latch 12. For example, the operator would have the two locking line 62 tails in one hand and the two opening line 64 tails in the other hand. If the operator only pulled on one tail, the operator would disconnect the line from the latch 12. This is the method of disconnecting the lines 60 from the latch 12 when in use.

Figure 4:
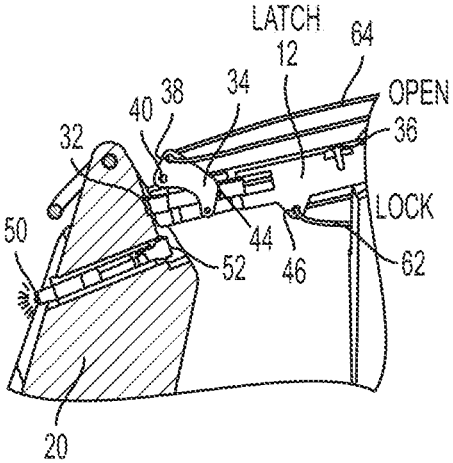
FIG. 4 is a partial cross-sectional view of the hook assembly of FIG. 1 showing components of one independent embodiment of the latch assembly.

As shown in FIGS. 4-6, the latch 12 includes apertures 38 and 46 to connect to lines 64 and 62, respectively. When the lines are disconnected (as noted above), an ROV can manipulate the lever with an aperture 40 on the lever 34 of the latch 12.

Since these lines 60 may be operated twenty meters above deck level, there can be risks of entanglement. For example, wind can grab the lines and twist them and make operation difficult. Below, will be described an embodiment which may prevent this.

Figure 7:
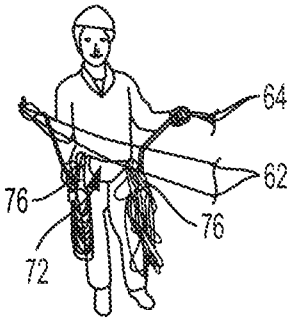
FIG. 7 is a partial perspective view of lines and a harness used to manipulate the latch assembly.
Figure 8:
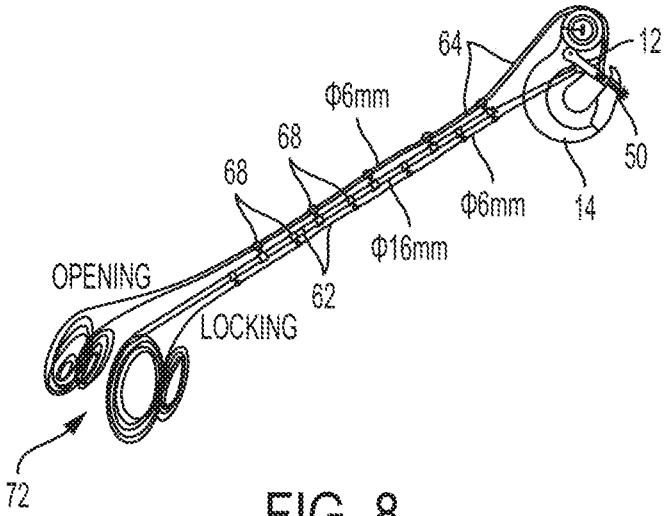
FIG. 8 is a perspective view of a line system used to manipulate the latch assembly.
Figure 9:
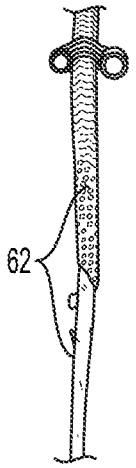
FIG. 9 is a view of a line arrangement for the locking line, wherein the locking line has a large diameter portion and a small diameter portion, and a tapered section between the larger diameter portion and the small diameter portion. Eyelets are also shown, which are used to separate lines.

As shown in FIGS. 7 and 8, the locking line 62 has a first relatively large diameter end (e.g., about 16 mm) and preferably made with a mix of HMPE (white) and polyester (red) over about half the length of the line. This is the main carrying line. The other half-length is preferably 100% HMPE fiber and has a relatively small diameter (e.g., about 6 mm). Eyelets 68 are mounted on regular intervals (e.g., every 0.5 m) on the larger diameter carrying line. The smaller diameter portion of the locking line 62 is then fed through the guides 66 on hook 14, aperture 46 on latch 12 and then through every second eyelet 68 on the larger diameter portion of the locking line 62 (carrying line).

The opening line 64 is also preferably relatively small diameter (e.g., about 6 mm) and is fed through every second eyelet 68 on the carrying line 62 to the hook 14, through the guides 66 and the aperture 38 on the latch 12. In this way, the two lines 60 are separated to prevent twisting, while being guided along the whole length to function as "one" line to the hook 14.

In operation, the hook 14 and lines 60 are set-up as discussed above. The opening line 64 can be pulled with one hand to open the latch 12. The opening line 64 can actuate the lever 34 to cause the cam surface 44 to engage and move the pin 32 out of engagement with the distal end 20 of the hook 14. The latch 12 can then pivot about its proximal end 28 to a fully opened position. Once the latch 12 is fully opened, the magnet 36 holds the latch 12 against the proximal end 18 of the hook 14.

The load can then be applied to the hook 14. Guide lines (not shown) can be used to manipulate the position of the hook 14.

Once the load is applied, the locking line 62 can be actuated with one hand to pull the latch 12 toward the closed position shown in FIG. 1. Upon closing, the distal end 30 of the latch 12 will engage the distal end 20 of the hook 14 to close off the opening in the hook 14. The pin 32 will engage the contact switch 52 of the indicator 50 to lock the latch 12 and illuminate the indicator 50 to indicate the latch 12 is locked.

When desired, the lines 60 can be removed from the hook 14. This is preferably done by removing the opening line 64 first. To remove the opening line 64, the operator releases one of the ends of the opening line 64 and pulls the other end. This will cause the released end to unthread or otherwise disengage the latch 12, the guide 66, and the eyelets 68. Next, the locking line 62 can be removed in a similar fashion. Since the locking line 62 has a large diameter end, the locking line 62 can only be pulled out in one direction. The locking line 62 should be the last one removed to avoid accidental opening of the latch 12 during disconnection of lines 60.

As noted above, an operator on the ground manipulates the lines 60 to remotely place the latch 12 in the desired condition. As shown in FIG. 7, the operator can have a harness 72 for easy handling and coiling up long length lines as the operator moves around on the ground. The harness 72 can have a belt with two line collectors 76 connected to the belt. In some embodiments, the line collectors are Velcro (i.e., hook and loop fastener) loops. With this configuration, the lines 60 can be released from the harness 72 quickly, if necessary.

The independent embodiments described above and illustrated in the figures are presented by way of example only and are not intended as a limitation upon the concepts and principles of the present invention. As such, it will be appreciated by one having ordinary skill in the art that various changes in the elements and their configuration and arrangement may be possible without departing from the spirit and scope of the present invention. For example, various alternatives to the certain features and elements of the present invention are described with reference to specific independent embodiments of the present invention. With the exception of features, elements, and manners of operation that are mutually exclusive of or are inconsistent with each embodiment described above, it should be noted that the alternative features, elements, and manners of operation described with reference to one particular independent embodiment are applicable to the other independent embodiments.

One or more independent features and/or independent advantages of the invention may be set forth in the claims.

What is claimed is:

1. An apparatus for remotely locking and unlocking a latch of a lifting hook, the apparatus comprising:

a first line coupled to the latch and extending to an operator located remotely from the lifting hook, manipulation of the first line moving the latch toward a locked condition with respect to the hook; and a second line coupled to the latch and extending to the operator located remotely from the lifting hook, manipulation of the second line moving the latch toward an unlocked condition with respect to the hook;

wherein the first line has a first end, a second end, and a middle, the middle of the first line being coupled to the latch and the first end and the second end being manipulated by the operator; and wherein the second line has a first end, a second end, and a middle, the middle of the second line being coupled to the latch and the first end and the second end being manipulated by the operator.

2. The apparatus of claim 1, further comprising a visual indicator providing an indication when the latch is in the locked condition.

3. The apparatus of claim 2, wherein the indicator includes a light that illuminates when the latch is in the locked condition.

4. The apparatus of claim 1, wherein the first line has a first diameter on the first end and a second diameter on the second end, the first diameter being larger than the second diameter.

5. The apparatus of claim 4, further comprising a plurality of eyelets coupled to the first diameter end of the first line, the eyelets guiding the second end of the first line and the first end and the second end of the second line.

6. The apparatus of claim 4, further comprising a harness to be worn by the operator for managing the ends of the first line and the second line, the harness having a line gathering portion with a quick release device to allow the line to be released from the harness.

7. The apparatus of claim 1, further comprising line guides coupled the hook, each line guide controlling a position of a line along the hook to generate a force in a direction on the latch.

8. The apparatus of claim 1, wherein the lifting hook includes a pin coupled to the latch, the pin being adapted to engage a main body of the hook in the locked condition, and a lever coupled to the latch, and wherein manipulation of the second line actuates the lever to disengage the pin from the main body and moves the latch toward the unlocked condition.

9. A lifting hook comprising:

a main body having a body proximal end and a body distal end defining an opening;

a latch for selectively locking and unlocking the lifting hook, the latch having a latch proximal end and a latch distal end, the latch proximal end being pivotally connected to the main body;

an actuator coupled to the latch and adapted to pivot the latch about the proximal end between a closed position and an open position;

a magnet positioned to magnetically hold the latch in an open position against a portion of the body proximal end; and a biased pin coupled to the latch distal end, the biased pin being adapted to lock the latch to the main body in the closed position;

wherein the biased pin is biased in a direction to extend from the latch distal end, and wherein the hook further comprises a lever coupled to the latch and actuatable to move the biased pin in a direction against the biasing force to retract the pin.

10. The lifting hook of claim 9, wherein the latch has a locked condition and an unlocked condition, the lifting hook further comprising an indicator coupled to the hook to indicate the condition of the latch.

11. The lifting hook of claim 10, wherein the indicator includes a visual indicator providing visible indicia.

12. The lifting hook of claim 11, wherein the indicator includes a light that illuminates when the latch is in the locked condition.

13. The lifting hook of claim 10, further comprising a contact switch, the biased pin being engageable with the contact switch to cause the indicator to provide an indication.

14. The lifting hook of claim 13, wherein the biased pin engages a pin opening in the body to operate the contact switch.

15. The lifting hook of claim 9, wherein the actuator actuates the lever.

16. The lifting hook of claim 15, wherein the actuator includes a line manipulated remotely by an operator on the ground.

17. A lifting hook comprising:

a main body having a body proximal end and a body distal end defining an opening;

a latch for selectively locking and unlocking the lifting hook, the latch having a latch proximal end and a latch distal end, the latch proximal end being pivotally connected to the main body;

an actuator coupled to the latch and adapted to pivot the latch about the proximal end between a closed position and an open position; and a magnet positioned to magnetically hold the latch in an open position against a portion of the body proximal end;

wherein the latch has a locked condition and an unlocked condition, the lifting hook further comprising an indicator coupled to the hook to indicate the condition of the latch;

wherein the indicator includes a light that illuminates when the latch is in the locked condition;

wherein the lifting hook further comprises a switch to illuminate the indicator, connection of the latch distal end to the body distal end operating the switch;

wherein the latch further includes a biased pin that engages a pin opening in the body to operate the switch.

* * * * *